US006257955B1

(12) United States Patent
Springer et al.

(10) Patent No.: US 6,257,955 B1
(45) Date of Patent: Jul. 10, 2001

(54) APPARATUS AND METHOD FOR HEATING A LIQUID OR VISCOUS POLISHING AGENT, AND DEVICE FOR POLISHING WAFERS

(75) Inventors: Götz Springer, Dresden (DE); Wolfgang Diewald, Fontainebleau (FR); Andre Richter, Neustadt/Sachsen (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/515,176

(22) Filed: Feb. 29, 2000

Related U.S. Application Data

(63) Continuation of application No. PCT/DE98/02492, filed on Aug. 24, 1998.

(30) Foreign Application Priority Data

Aug. 29, 1997 (DE) ..... 197 37 849

(51) Int. Cl.[7] ..... B24B 49/00

(52) U.S. Cl. ..... 451/7; 451/53; 451/60; 451/446

(58) Field of Search ..... 451/7, 53, 60, 451/446, 488, 56, 285, 41

(56) References Cited

U.S. PATENT DOCUMENTS

| | | | | |
|---|---|---|---|---|
| 2,384,225 | * | 9/1945 | Wilson | 51/267 |
| 4,481,741 | | 11/1984 | Bouladon et al. . | |
| 4,513,894 | * | 4/1985 | Doyle et al. | 222/644 |
| 5,127,196 | | 7/1992 | Morimoto et al. . | |
| 5,364,655 | | 11/1994 | Nakamura et al. . | |
| 5,478,435 | | 12/1995 | Murphy et al. . | |
| 5,658,183 | | 8/1997 | Sandhu et al. . | |
| 5,775,980 | * | 7/1998 | Sasaki et al. | 451/285 |
| 5,957,750 | * | 9/1999 | Brunelli | 451/7 |

FOREIGN PATENT DOCUMENTS

| | | |
|---|---|---|
| 90 02 296 | 6/1990 | (DE) . |
| 0 566 258 A1 | 10/1993 | (EP) . |
| 0 822 033 A1 | 2/1998 | (EP) . |
| 811665 | 4/1959 | (GB) . |
| 2-250771 | 10/1990 | (JP) . |

OTHER PUBLICATIONS

Patent Abstracts of Japan No. 254579 A (Yasutaka et al.), dated Oct. 3, 1995.

"Heat Exchanger made of technical synthetic materials", CAV, Dec. 1988, p. 63.

* cited by examiner

*Primary Examiner*—Timothy V. Eley
*Assistant Examiner*—Dung Van Nguyen
(74) *Attorney, Agent, or Firm*—Herbert L. Lerner; Laurence A. Greenberg; Werner H. Stemer

(57) ABSTRACT

An apparatus for polishing wafers includes a polishing table with a heating device. A conduit connects a tank holding a liquid polishing agent to a distributor for feeding the liquid polishing agent to the polishing table. A heat exchanger is disposed along the conduit between the tank and the distributor for heating the liquid polishing agent. The heat exchanger is independent of said heating device. A method for heating a polishing agent is also provided.

24 Claims, 3 Drawing Sheets

APPARATUS AND METHOD FOR HEATING A LIQUID OR VISCOUS POLISHING AGENT, AND DEVICE FOR POLISHING WAFERS

CROSS-REFERENCE TO RELATED APPLICATIONS

This application is a continuation of copending International Application PCT/DE98/02492, filed Aug. 24, 1998, which designated the United States.

BACKGROUND OF THE INVENTION

FIELD OF THE INVENTION

The invention relates to an apparatus and to a method for heating a liquid or viscous medium, in particular a polishing agent for a chemical mechanical polishing. Furthermore, the invention relates to an apparatus for polishing, in particular for a chemical mechanical polishing of wafers.

Depending on the strength of the chemical component of the polishing process, the temperature during chemical mechanical polishing (CMP) has a decisive influence on the process result. In this case, the process temperature, that is to say the temperature on the side of the wafer to be polished during the polishing operation, is influenced essentially by three thermal components: 1) the frictional heat occurring during the polishing process; 2) the heating of the polishing table; and 3) the temperature of the polishing agent (slurry).

The frictional heat produced during the polishing process can be influenced only in a limited manner, since the polishing pressure and the rotational speeds of the table and the carrier are generally subject to other process preconditions. Heating for the polishing table is usually provided in the apparatuses for polishing.

A specific and defined setting of the temperature of the polishing agent has so far not been taken into consideration. If the temperature of the polishing agent is controlled at all, this is done in such a way that the conduit for the polishing agent is guided through the heating device which is responsible for the temperature control of the polishing table. Such heating has, however, the disadvantage that it is not possible for the polishing agent and the polishing table to be heated independently.

In a further known apparatus, a heating coil is wound around the conduit for the polishing agent. However, this has the disadvantage that by comparison with the desired temperature of the polishing agent the heating coil operates at very high temperatures in order to be able to react quickly to temperature fluctuations. However, this can lead locally to very high temperatures in the polishing agent and thus to a degradation of the polishing agent.

SUMMARY OF THE INVENTION

It is accordingly an object of the invention to provide a method and an apparatus for heating a liquid or viscous medium which overcome the above-mentioned disadvantages of the heretofore-known methods and apparatuses of this general type and which make it possible to set the temperature of the polishing agent in a defined manner independently of other process parameters.

It is furthermore an object of the invention to provide an apparatus for polishing wafers which allows to polish the wafers simply and satisfactorily while avoiding the above-mentioned disadvantages.

The object of the invention is achieved by an apparatus for heating a liquid or viscous medium, in particular a polishing agent for chemical mechanical polishing, having a conduit for the medium to be heated and a heating device for the medium, the heating device being constructed as a heat exchanger which is disposed at the conduit for the medium to be heated.

With the heating apparatus according to the invention, it is possible to provide the polishing agent always at a precisely defined and constant temperature for the polishing process, virtually independently of the fact that the polishing agent is not continuously removed because of the polishing cycle which has a loading phase, a polishing phase and an unloading phase.

In accordance with a preferred embodiment, a heating agent, preferably a glycol-water mixture or deionized water, can flow through the heat exchanger. The selection of the heating agent is however not limited to these two variants. The temperature of the heating agent is advantageously set with a heating controller to a value between 30 and 90° C., preferably between 45 and 70° C., and most preferably between 55 and 60° C. The heating controller is advantageously a thermostat, and has a power of approximately 3 kW, for example. The transportation of the heating agent from a tank provided therefor into the heat exchanger can be supported, for example, by a pump which can have a performance of approximately 24 l/min. If the heating controller for the heating agent is disposed in the heating agent tank, then this configuration has the advantage that the heating agent temperature in the heat exchanger corresponds virtually to the heating agent temperature in the heating agent tank, wherein it is possible to provide the heating agent tank separated and away from the heat exchanger. However, the heating controller can also be provided directly in the heat exchanger.

In accordance with another feature of the invention, the conduit for the medium (polishing agent) to be heated can have a conduit region which is connected to a tank for the medium to be heated, and a conduit region which is connected to a distributor. The latter conduit region is advantageously short by comparison with the first-named conduit region. That is to say, the heat exchanger of the heating apparatus according to the invention is provided in the immediate vicinity of the distributor. The short length of the conduit ensures that the medium cannot cool down much after exiting from the heat exchanger and until entering the distributor. The defined adjustability of the temperature of the medium—for example the polishing agent—is therefore further increased.

In accordance with a further feature of the invention, the heat exchanger has a conduit section which is flushed on its outside by a heating agent. The conduit section is advantageously connected to the two conduit regions of the conduit for the medium (polishing agent) to be heated. The conduit section can, for example, be a spiral hose, but other configurations are also possible.

In accordance with another feature of the invention, the heat exchanger can have a cover with inlet openings on the incoming side. For example, two inlet openings for the heating agent conduit and the corresponding conduit region of the conduit for the medium (polishing agent) to be heated are provided. Furthermore, the heat exchanger can have a cover with outlet openings on the outgoing side. Again, two outlet openings can be provided for the conduits mentioned with regard to the incoming openings. Finally, the heat exchanger can have a medium pipe and at least one limiting rod. The limiting rod serves the purpose of holding the conduit section inside the heat exchanger in a precisely defined position, so that the conduit section is flushed on its outside simultaneously from all sides with heating agent, and the medium (polishing agent) to be heated, which is provided in it, is heated to a uniform, defined temperature.

The cover can advantageously have an outside diameter of approximately 126 mm and a maximum thickness in the region of the openings of 15 mm. An exemplary embodiment of the heat exchanger has a length of 510 to 540 mm.

According to another feature of the invention, the flow rate of the medium to be heated can be in the range of 100 to 1000 ml/min in the individual conduit regions and/or in the conduit section of the heat exchanger. Preferred flow rates are, for example, 150 ml/min, 200 ml/min and 250 ml/min.

The individual elements of the heat exchanger can advantageously be formed from a plastic, preferably from a polyurethane-based plastic or a PVA (polyvinyl alcohol) based plastic. The invention is not, however, limited to the use of these materials. Rather, any material can be used which has a suitable thermal conductivity, chemical stability with respect to the medium to be heated, and thermal stability. In particular, it is possible to use those materials which are, furthermore, compatible with the purity requirements and contamination requirements of the semiconductor industry.

According to the invention, the inside diameter of the conduit regions and/or of the conduit section can be 5 to 8 mm, preferably approximately 6.4 mm.

In accordance with another feature of the invention, the conduit region, leading towards the heat exchanger and/or away from it, of the conduit for the medium to be heated can additionally be thermally insulated. In particular, the additional insulation of the conduit region leading from the heat exchanger to the distributor further enhances the precise adjustability of the temperature of the medium.

As a result of the heating device according to the invention as described above, the temperature of the medium to be heated—for example, a polishing agent—can be set independently of other process parameters and in a precisely defined fashion. The reason for this, inter alia, is that the heat exchanger is disposed in the immediate vicinity of the distributor. A cooling of the medium after exiting from the heat exchanger is therefore prevented. An additional minimizing of the heat loss can be achieved by the additional thermal insulation of the conduits. Furthermore, the quantity of the polishing agent and the period over which the polishing agent has a raised temperature can be minimized with the positioning of the heat exchanger according to the invention. A degradation of the polishing agent is thereby avoided.

The required dimensioning of the heat exchanger can be determined by the formulae given below. The required heating power is calculated using the formula $$Q=c_p\rho V(T_{out}-T_{in})+\text{power loss} \tag{1}$$

The temperature downstream of the conduit section 1 in the heat exchanger is yielded from $$T(l) = T_{Bad} - (T_{Bad} - T_{in})e^{-\frac{1}{B}l} \quad \text{where} \tag{2}$$

$$B = \frac{1}{2\pi}\frac{c_p\rho}{\lambda}\ln\frac{r_a}{r_i}\dot{V} \tag{3}$$

In this case, $T_{Bad}$ indicates the temperature of the heating agent, $T_{in}$ indicates the input temperature of the medium to be heated at the heat exchanger, $T_{out}$ indicates the output temperature of the heated medium upon exiting from the heat exchanger, $c_p$ signifies the thermal capacitance of the medium to be heated, ρ signifies the density of the medium to be heated, λ signifies the thermal conductivity of the conduit material of the conduit section, $r_a$ signifies the outside radius of the conduit section, $r_i$ signifies the inside radius of the conduit section, and V signifies the flow rate of the medium to be heated.

The required length of the conduit section located in the heat exchanger at a desired output temperature of the medium $T_{out}$ at the output of the heat exchanger is yielded after appropriate transformation of equation (2) in terms of the length 1 as $$l = B\ln\frac{T_{Bad} - T_{in}}{T_{Bad} - T_{out}} \tag{4}$$

With the objects of the invention in view there is also provided, an apparatus for polishing wafers, including:

- a polishing table for placing a wafer thereon, the polishing table having a heating device;
- a tank for holding a liquid polishing agent;
- a distributor;
- a conduit connecting the tank to the distributor for feeding the liquid polishing agent to the polishing table; and
- a heat exchanger disposed along the conduit between the tank and the distributor for heating the liquid polishing agent, the heat exchanger being independent of the heating device.

In other words, in accordance with the invention, an apparatus is provided for polishing wafers, in particular for a chemical mechanical polishing of wafers, having a polishing table, wherein a polishing agent is applied to the polishing table via a distributor. The polishing agent has a temperature adjusted in a defined fashion at the distributor. A heating apparatus according to the invention as described above is used for the purpose of setting the polishing agent temperature.

It is possible for temperature fluctuations in the polishing agent to be minimized by such a device even in the case of non-continuous tapping or extraction. It is thereby possible to carry out polishing processes in an optimum fashion. Since important aspects of the polishing apparatus according to the invention result from the heating apparatus according to the invention, reference is made to the advantages, results, effects and functions described in context with the heating apparatus.

In accordance with an advantageous feature of the invention, the heating apparatus, and in particular the heat exchanger, can be provided in the vicinity of the distributor. As a result, in addition to the advantages mentioned with regard to the heating apparatus, it is possible, in particular, to reduce the heat losses inside the conduit region leading from the heat exchanger to the distributor.

In accordance with another feature of the invention, the temperature of the polishing agent at the distributor is in the region of between 20 and 80° C.

According to the invention, the polishing table can be heated via a heating device independent of the heating apparatus of the invention. As a result, the process temperature can be set even more precisely during polishing of the wafer.

With the objects of the invention in view there is also provided, in accordance with the invention, a method for heating a polishing agent for a chemical mechanical polishing. The method includes the steps of:

heating a heating agent using a heating controller;

introducing the heated heating agent into a heat exchanger;

guiding a polishing medium to be heated through the heated heating agent in the heat exchanger; and outputting the heated polishing medium from the heat exchanger to a distributor.

In other words, a method is provided for heating a liquid or viscous medium, in particular a polishing agent for a chemical mechanical polishing, in particular by using a heating apparatus according to the invention in an apparatus for polishing wafers according to the invention. As described above, the method is characterized by the following steps: 1) introducing a heated heating agent into a heat exchanger via a heating controller; 2) feeding the medium to be heated through the heated heating agent in the heat exchanger; and 3) outputting the heated medium from the heat exchanger to a distributor in the vicinity of the distributor.

The advantages, results, effects and functions described with reference to the heating apparatus and polishing apparatus according to the invention are thereby achieved, and thus reference is made to the above description relating to these aspects of the invention.

In accordance with another mode of the invention, the temperature of the heating agent can be set to a temperature in the range of 30 to 90° C., preferably 45 to 70° C., and most preferably 55 to 60° C.

In accordance with yet another mode of the invention, the medium to be heated can be conducted through the heat exchanger at a flow rate of 100 to 1000 ml/min.

Finally, when being output from the heat exchanger to the distributor the medium to be heated can advantageously have a temperature between 20 and 80° C.

Other features which are considered as characteristic for the invention are set forth in the appended claims.

Although the invention is illustrated and described herein as embodied in an apparatus and method for heating a liquid or viscous polishing agent, and a device for polishing wafers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
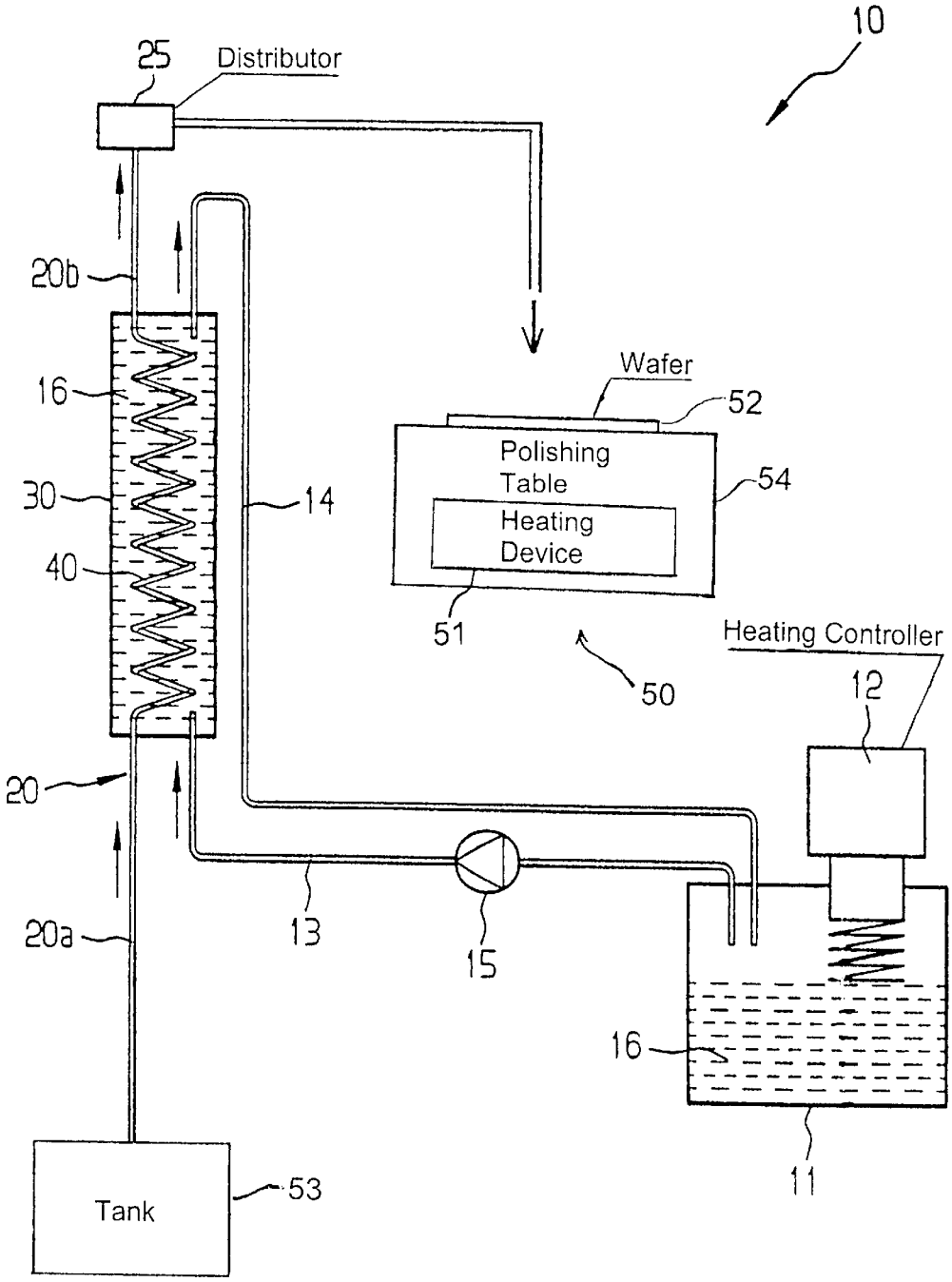
FIG. 1 is a schematic view of the structure of an exemplary embodiment of the heating apparatus according to the invention.

Referring now to the figures of the drawings in detail and first, particularly, to FIG. 1 thereof, there is shown a heating apparatus 10 for heating a polishing agent for a chemical mechanical polishing. The heating apparatus 10 generally includes a heating agent tank 11 in which a heating agent 16 can be heated via a heating controller 12. The heating agent tank 11 is connected to a heat exchanger 30 on the incoming side thereof via a conduit 13 in which a pump 15 is additionally provided. Provided on the outgoing side of the heat exchanger 30 is a further conduit 14 for the heating agent 16, via which the heating agent 16 is returned to the heating agent tank for the purpose of a renewed heating after leaving the heat exchanger 30.

The heat exchanger 30 further has a conduit section 40 which is flushed on its outer side by the heating agent in the heat exchanger 30 and which is connected on the incoming side to a conduit region 20*a*, and on the outgoing side to a conduit region 20*b* of a conduit 20. The polishing agent to be heated is led by the conduit 20 from a polishing agent tank 53 through the heat exchanger 30 to a distributor 25 in a schematically shown polishing device 50, and is heated in the heat exchanger 30 in the process. The schematically shown polishing device 50 has a polishing table 54 for placing a wafer 52 on it and also has a heating device 51, which can be operated independently from the heat exchanger 30.

Figure 2:
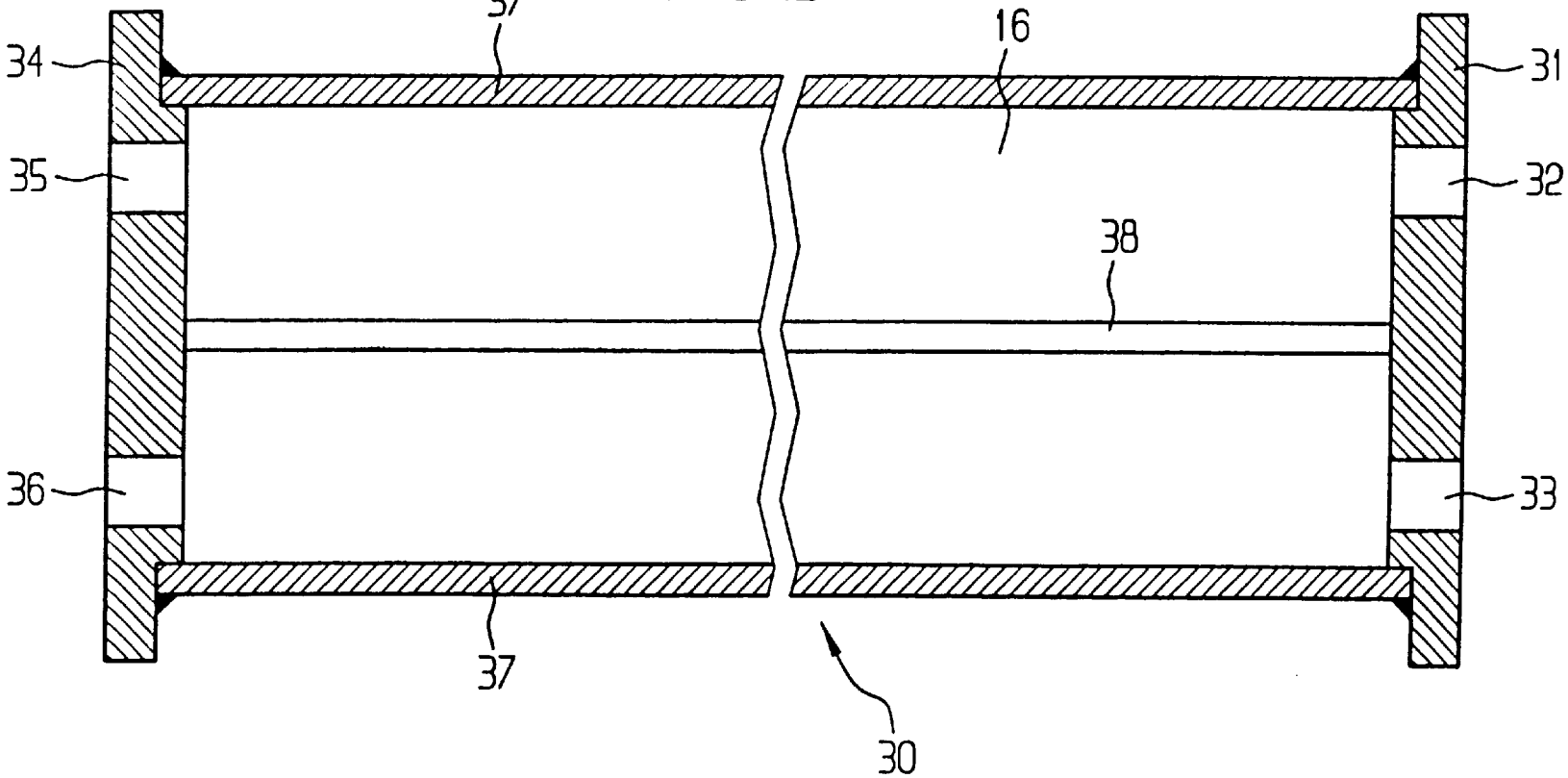
FIG. 2 is a diagrammatic cross-sectional view of the heat exchanger of the heating apparatus according to the invention.

The basic configuration of the heat exchanger 30 can be seen in FIG. 2. The heat exchanger 30 has a cover 31 with two inlet openings 32, 33 for the conduits 13 and 20*a*. Likewise provided on the outgoing side is a cover 34 with two outlet openings 35, 36 for the conduits 14 and 20*b*. A medium pipe 37 is provided between the covers. The covers 31, 34 are welded to the medium pipe 37 and thereby form a closed container for holding the heating agent 16.

Figure 3:
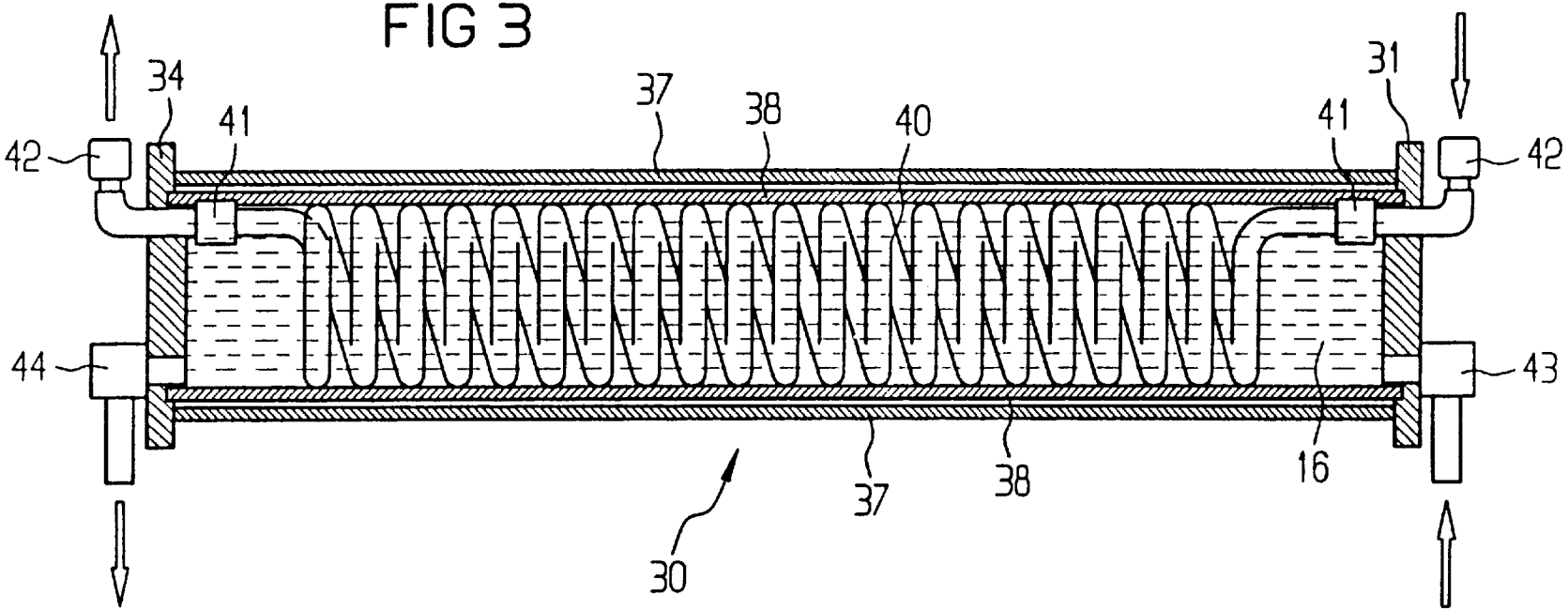
FIG. 3 is a detailed cross-sectional view of the heat exchanger shown in FIG. 2.

As follows further from FIG. 3, the spirally constructed conduit section 40 is provided inside the medium pipe 37 of the heat exchanger 30. The conduit section 40 is held in a defined position inside the medium pipe 37 via three limiting rods 38. The result of this is to ensure that the conduit section 40 is continuously and uniformly flushed on its outside by the heating agent 16 at all points.

The conduit section 40 is connected respectively to the conduit regions 20*a* and 20*b* of the conduit 20 via a connecting element 41 and a connecting flange 42. The connection of the heating agent conduits 13 and 14 to the heat exchanger 30 is performed via an inlet stub 43 and an outlet stub 44.

The mode of operation of the heating apparatus 10 will now be described below.

The heating apparatus 10 is used, for example, when a wafer is to be polished in a polishing apparatus by a polishing agent. The polishing plate used for this purpose can be heated to a defined setting of the process temperature. The polishing agent to be used is fed into the polishing apparatus via a distributor 25. The advantageous heating of the polishing agent, through the use of which the polishing process can be further optimized, is made possible by the heating apparatus 10.

An essential element of the heating apparatus 10 is the heat exchanger 30. The first step is to introduce into the heat exchanger 30 a heating agent 16 which is heated outside the heat exchanger 30 in a heating agent tank 11 to a temperature of 30 to 90°, preferably to a temperature of 55 to 60°. A water-glycol mixture is used in the present case as heating agent. The heating is performed by a heating controller 12 which is constructed in the exemplary embodiment in the form of a thermostat with a power of 3 kW. The heating agent thus heated is fed into the heat exchanger 30 via the conduit 13 and the inlet stub 43. In order to permit a permanent circulation of the heating agent 16 through the heat exchanger 30, as a result of which it is possible to set a constant heating agent temperature in the heat exchanger, the heat exchanger is connected on the outgoing side via the outlet stub 44 to a heating agent conduit 14 which conducts the emerging heating agent for the purpose of a renewed heating back into the heating agent tank 11. The continuous circulation of the heating agent is achieved by a pump 15 which in the present case has a conveying capacity of 24 l/min.

In order to heat the polishing agent, the latter is firstly fed into the conduit region 20*a* of the conduit 20 from the polishing agent tank 53. The conduit region 20*a* is connected to the conduit section 40 via the connecting element 41 and the connecting flange 42. This section is located with a spiral construction inside the medium pipe 37 of the heat exchanger 30, and is uniformly and from all sides flushed on the outside by the heated heating agent. The polishing agent is heated to the desired temperature while spirally running through the conduit section 40.

On the outgoing side, the conduit section 40 is connected to the conduit region 20*b* via the connecting element 41 and the connecting flange 42, and to the distributor 25 via the conduit region.

The polishing agent temperature reached at the output of the heat exchanger 30 is therefore dependent on the temperature set in the water-glycol circuit, and on the flow rate set for the polishing agent. The rate is advantageously 150 ml/min, 200 ml/min or 250 ml/min. The polishing agent immediately downstream of the heat exchanger 30 can assume at most the temperature of the water-glycol mixture.

The polishing agent in the conduit region 20*b* cools down slightly after exiting from the heat exchanger 30 and before entering the distributor 25. Such a cooling can, however, be reduced by keeping the length of the conduit region 20*b* as short as possible. The resulting configuration or placement of the heat exchanger in the immediate vicinity surrounding the distributor 25 greatly reduces the possibility of a cooling of the polishing agent. In addition, the conduit region 20*b* can further be thermally insulated, as a result of which the cooling is reduced even more.

After entering the polishing apparatus through the distributor 25, the heated polishing agent can be used to polish the wafers.

The following effects must be taken into account with regard to the heating apparatus 10 when setting the suitable polishing agent temperature for the polishing process. The polishing agent cools slightly on the way from the heat exchanger 30 to the distributor 25. This has the effect that the polishing agent temperature at the distributor 25 is lower than immediately downstream of the heat exchanger 30.

Consequently, when the polishing agent exits from the heat exchanger 30 its temperature must be set such that it is somewhat higher than the desired temperature of the polishing agent.

In addition, there is the effect that when no polishing agent is removed the polishing agent present in the conduit region 20*b* downstream of the heat exchanger 30 cools down markedly. When a tapping or removal of the polishing agent begins, the cooled polishing agent first has to be pumped out of the conduit region 20*b*, until the desired temperature is established after some time. Since the conduit region 20*b* is, however, selected to be short and is in addition to that advantageously thermally insulated, the losses of nonusable polishing agent are small. Moreover, the desired temperatures are already established shortly after starting to remove or tap the polishing agent, such that no long time delays occur during the polishing process.

A concrete example of a dimensioning of the heating apparatus 10 undertaken in accordance with the formulas (1) to (4) will now be described below.

The temperature of the heating agent $T_{Bad}$ was set to a value of 55° C. The incoming temperature of the medium to be heated at the heat exchanger 30—that is to say in the conduit region 20*a*–$T_{in}$ was 20° C. The outgoing temperature of the heated medium upon exiting from the heat exchanger 30 into the conduit region 20*b* $T_{out}$ was 50° C. The thermal capacitance of water at 20° C., that is to say $c_p$ is equal to 4180 J/kgK, was used as thermal capacitance. Likewise, the density ρ of water was set to 1000 kg/M$^3$. The thermal conductivity λ had a value of 0.19 W/mK, a PVA (polyvinyl alcohol) plastic pipe being used as conduit section. The conduit section had an outside diameter $r_a$ of 8 mm and an inside radius $r_i$ of 6.4 mm. The flow rate ΔV/Δt of the polishing agent was 250 ml/min.

On the basis of these values, the formulas (1) to (4) were used to calculate a heating power of approximately 520 W and a required length 1 of the conduit section of 6.56 m.

Finally, it was investigated in a series of experiments how far the polishing agent temperatures differ upon exiting from the heat exchanger 30 from the temperatures of the heating agent 16 flushing the conduit section 40. The experiments were carried out for various heating agent temperatures and flow rates. The results are shown in the following Table 1.

TABLE 1

| Heating agent | Polishing agent temperature at a flow rate of | | |
|---|---|---|---|
| temperature (° C.) | 150 ml/min | 200 ml/min | 250 ml/min |
| 30 | 28.0 | 28.1 | 27.8 |
| 35 | 32.0 | 31.8 | 31.7 |
| 40 | 36.0 | 35.7 | 35.3 |
| 45 | 39.5 | 39.5 | 39.2 |
| 50 | 43.4 | 43.2 | 43.0 |
| 55 | 47.0 | 46.8 | 46.6 |

As may be seen from the results of Table 1, the polishing agent temperatures have a value which is respectively somewhat lower than the various heating agent temperatures. However, the value is approximately constant in each case for the various flow rates. Consequently, the desired polishing agent temperature value can be precisely set by a correspondingly higher setting of the heating agent temperature value.

We claim:

1. An apparatus for polishing wafers, comprising:

a polishing table for placing a wafer thereon, said polishing table having a heating device;

a tank for holding a liquid polishing agent;

a distributor connected to said polishing table;

a conduit connecting said tank to said distributor for feeding the liquid polishing agent to said polishing table; and a heat exchanger for heating the liquid polishing agent, said heat exchanger including at least a portion of said conduit that is disposed between said heat exchanger being independent of said heating device.

2. The apparatus according to claim 1, wherein said polishing table is configured as a chemical-mechanical polishing table.

3. The apparatus according to claim 1, including:

a heating controller connected to said heat exchanger; and said heat exchanger operating with a heating agent having a temperature, said heating controller setting the temperature to a value between 30 and 90° C.

4. The apparatus according to claim 3, wherein said heating controller sets the temperature of the heating agent to a value between 45 and 70° C.

5. The apparatus according to claim 3, wherein said heating controller sets the temperature of the heating agent to a value between 55 and 60° C.

6. The apparatus according to claim 1, wherein said conduit has a first conduit region between said heat exchanger and said tank, and a second conduit region between said heat exchanger and said distributor, said first conduit region is short compared to said second conduit region.

7. The apparatus according to claim 6, wherein said first conduit region and said second conduit region are configured for a flow rate to be adjusted in the range between 100 and 1000 ml/min.

8. The apparatus according to claim 6, wherein said first and second conduit regions have an inside diameter of between 5 and 8 mm.

9. The apparatus according to claim 6, wherein said first and second conduit regions have an inside diameter of 6.4 mm.

10. The apparatus according to claim 6, wherein at least one of said first and second conduit regions is additionally thermally insulated.

11. The apparatus according to claim 1, wherein said conduit has a first conduit region between said heat exchanger and said tank, and a second conduit region between said heat exchanger and said distributor, said heat exchanger has a conduit section connected to said first conduit region and to said second conduit region, said heat exchanger operates with a heating agent in contact with said conduit section.

12. The apparatus according to claim 11, wherein said conduit section is configured for a flow rate to be adjusted in the range between 100 and 1000 ml/min.

13. The apparatus according to claim 11, wherein said conduit section has an inside diameter of between 5 and 8 mm.

14. The apparatus according to claim 11, wherein said conduit section has an inside diameter of 6.4 mm.

15. The apparatus according to claim 1, wherein said heat exchanger has an incoming side and an outgoing side, a first cover formed with inlet openings at said incoming side, a second cover formed with outlet openings at said outgoing side, a medium pipe disposed between said first cover and said second cover, and at least one limiting rod.

16. The apparatus according to claim 1, wherein said conduit has a first conduit region between said heat exchanger and said tank, and a second conduit region between said heat exchanger and said distributor, said heat exchanger has a conduit section connected to said first conduit region and to said second region, said heat exchanger has an incoming side and an outgoing side, a first cover formed with inlet openings at said incoming side, a second cover formed with outlet openings at said outgoing side, and a medium pipe disposed between said first cover and said second cover, and wherein said first cover, said second cover, said medium pipe and said conduit section are formed of a plastic material.

17. The apparatus according to claim 16, wherein said plastic material is one of a polyurethane-based plastic material and a polyvinyl-alcohol-based plastic material.

18. A method for heating a polishing agent for a chemical mechanical polishing, the method which comprises:

heating a heating agent using a heating controller, resulting in a heated heating agent;

introducing the heated heating agent into a heat exchanger;

storing a polishing medium in a storage tank;

guiding the polishing medium from the storage tank to the heat exchanger and guiding the polishing medium through the heated heating agent in the heat exchanger, resulting in a heated polishing medium; and outputting the heated polishing medium from the heat exchanger to a distributor.

19. The method according to claim 18, which comprises setting a temperature of the heated heating agent to a value between 30 and 90° C.

20. The method according to claim 18, which comprises setting a temperature of the heated heating agent to a value between 45 and 70° C.

21. The method according to claim 18, which comprises setting a temperature of the heated heating agent to a value between 55 and 60° C.

22. The method according to claim 18, which comprises guiding the polishing medium through the heat exchanger at a flow rate of 100 to 1000 ml/min.

23. The method according to claim 18, which comprises outputting the heated polishing medium, from the heat exchanger to the distributor, with a temperature of between 20 and 80° C.

24. The method according to claims 18, which comprises using a water-glycol mixture as the heating agent.

* * * * *